US011882919B2

(12) United States Patent
Mai, Jr. et al.

(10) Patent No.: US 11,882,919 B2
(45) Date of Patent: Jan. 30, 2024

(54) EYELASH PLATE ASSEMBLY

(71) Applicants: Joseph B. Mai, Jr., San Diego, CA (US); Ngha P. Mai, San Diego, CA (US)

(72) Inventors: Joseph B. Mai, Jr., San Diego, CA (US); Ngha P. Mai, San Diego, CA (US)

( * ) Notice: Subject to any disclaimer, the term of this patent is extended or adjusted under 35 U.S.C. 154(b) by 150 days.

(21) Appl. No.: 17/138,891

(22) Filed: Dec. 30, 2020

(65) Prior Publication Data

US 2021/0204676 A1 Jul. 8, 2021

Related U.S. Application Data

(60) Provisional application No. 62/955,401, filed on Dec. 30, 2019.

(51) Int. Cl.
*A41G 5/02* (2006.01)
*A45D 44/04* (2006.01)

(52) U.S. Cl.
CPC ..... *A45D 44/04* (2013.01); *A41G 5/02* (2013.01)

(58) Field of Classification Search
CPC ..... A41G 5/02; A45D 44/02
See application file for complete search history.

(56) References Cited

U.S. PATENT DOCUMENTS 8,424,542 B1 * 4/2013 Han ..... A41G 5/02 132/218
2016/0353861 A1 * 12/2016 Carey ..... A41G 5/02

FOREIGN PATENT DOCUMENTS

DE 2016006448 * 12/2016
KR 101404794 * 6/2014

* cited by examiner

*Primary Examiner* — Rachel R Steitz
*Assistant Examiner* — Brianne E Kalach
(74) *Attorney, Agent, or Firm* — Bryan Fibel

(57) ABSTRACT

An eyelash plate assembly for use with eyelash application is provided. The assembly comprises a lash plate and a lash tile, the tile having been prepared with the eyelashes to be applied. The assembly can further include a means for supporting and positioning the plate near the customer's face for application. This allows for the stylist to apply the eyelashes in an efficient and safe manner.

19 Claims, 12 Drawing Sheets

EYELASH PLATE ASSEMBLY

CROSS REFERENCE TO RELATED APPLICATIONS

This application claims priority from a non-provisional U.S. patent application Ser. No. 62/955,401 filed on Dec. 30, 2019.

FIELD OF THE INVENTION

Embodiments of the invention generally relate to an assembly for use with eyelash extensions. Embodiments of the invention specifically relate to an eyelash plate assembly for use in the application of eyelashes.

BACKGROUND OF THE INVENTION

Eyelash extensions are cosmetic enhancements that are designed to add length, thickness and fullness to natural eyelashes. The eyelash extensions are adhered to the natural eyelashes with an adhesive. A stylist will use a tweezer to grab one or more lashes at a time, dip in the adhesive, and place onto a customer's lashes. A second tweezer is used to isolate the client's natural lash in order to place the synthetic lashes on until the desired fullness has been achieved. As eyelash extensions increase in popularity, there is a need to improve the efficiency and safety of the lash application process.

SUMMARY

An eyelash plate assembly for use with eyelash application is provided. The disclosed invention allows for eyelashes to be immediately positioned near a customer's face and to be applied directly to the customer.

An eyelash plate assembly comprises a lash plate and a lash tile. The lash plate is a flat plate capable of receiving a lash tile in a cavity on the front surface of the plate. The last tile is a flat tile prepared with eyelashes on the front surface of the tile and capable of being inserted into the lash plate cavity. The lash plate cavity can be fully enclosed within the perimeter of the lash plate.

The lash plate cavity can opens at the top edge of the lash plate for insertion of the lash tile at the top edge of the lash plate. The eyelash plate further include an arm attached to the lash plate at one end and having a means for securing to objects at the opposite end. The arm can be attached to the lash plate via a ball and socket joint. The eyelash plate assembly can further include a stand attached to the lash plate and having a base that rests on a surface, where the stand can be stationary or movable. The lash tile can be located on the left half of the lash plate surface or on the right half of the lash plate surface. The eyelash plate assembly can further include holders for holding a cup containing adhesive. The lash can extends past the top of the lash plate such that it can be grip for insertion and removal of the lash tile from the lash plate.

DETAILED DESCRIPTION

Reference will now be made in detail to the present embodiments discussed herein, illustrated in the accompanying drawings. The embodiments are described below to explain the disclosed invention by referring to the Figures using like numerals. It will be nevertheless be understood that no limitation of the scope is thereby intended, such alterations and further modifications in the illustrated device, and such further applications of the principles as illustrated therein being contemplated as would normally occur to one skilled in the art to which the embodiments relate. Those skilled in the art will recognize that other implementations may be performed that may include different structures or components that perform similar tasks.

An eyelash plate assembly for use with eyelash application is provided. The assembly comprises a lash plate and a lash tile, the tile having been prepared with the eyelashes to be applied. The assembly can further include a means for supporting and positioning the plate near the customer's face for application. This allows for the stylist to apply the eyelashes in an efficient and safe manner.

A tray of eyelashes is prepared for a stylist. The stylist will typically remove the lashes from the tray and intermediately place them on the back of his/her wrist so that the lashes are near a customer's face. Then the stylist will apply the eyelashes to the customer. The disclosed invention removes the intermediate step such that, the eyelash plate assembly allows for the lashes to be immediately positioned near the customer's face and to then be applied directly to the customer. The eyelash plate assembly improves the efficiency of the eyelash application process. Hygiene is improved by not placing the eyelashes on the stylist's wrist. The precision and care required by the stylist requires that the lashes be positioned near the client's face for application. Thus safety is improved by reducing the distance the between the eyelashes and the customer.

Figure 1:
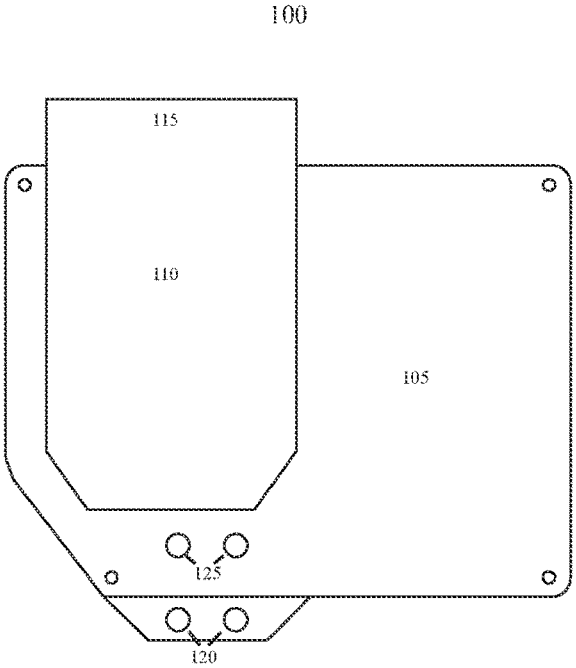
FIG. 1 is a front view 100 of a lash plate and lash tile.

As illustrated in FIG. 1, a front view of a lash plate and lash tile embodiment 100 is provided. In the preferred embodiment, a lash plate 105 is a plate or container capable of receiving a lash tile. The lash tile 110 is temporarily inserted into or secured to the lash plate. As depicted in the preferred embodiment, the lash plate 105 has a cavity where the lash tile 110 is temporarily inserted into. In other embodiments, magnets, fasteners or other means may be used to attach, or secure the lash tile to the lash plate. The lash plate 105 may be large enough to allow for the resting of a hand or arm on the surface, though not necessarily. Additionally, it can allow for the placement of utensils or items including, but not limited to, glue, primer, removal solution, lashes, tape, tweezers, pads or micro brushes. Such a lash plate could additionally have a recess or more shallow indentations for the items or utensils.

In the preferred embodiment, the lash plate has one of more holders 120 capable of holding the adhesive used to apply the eyelashes. In the depicted embodiment, these holders are holes that hold a single-use cup containing the adhesive, though a concavity or other holder may be contemplated. The lash plate may additionally or alternatively have holder 125 directly on the last plate, such holders being holes or concavities, capable of holding adhesive used to apply the eyelashes. No limitation is intended with the size, position, or shape of the holders as depicted.

The lash tile 110 is prepared with eyelashes to be applied to the customer. This preparation can be done quickly and allows for the eyelashes to be transported to the lash plate 105. In the preferred embodiment, the lash tile 110 is temporarily inserted into the lash plate cavity. In other embodiments, magnets, fasteners or other means may be used to attach or secure the lash tile to the lash plate. In the depicted embodiment, a portion 115 of the lash tile extends outside the perimeter of the lash plate 105 so that it can be easily gripped for easy insertion and removal. In other embodiments, a lash tile can include a more defined handle or grip or other means to allow for easy insertion or removal.

Figure 2:
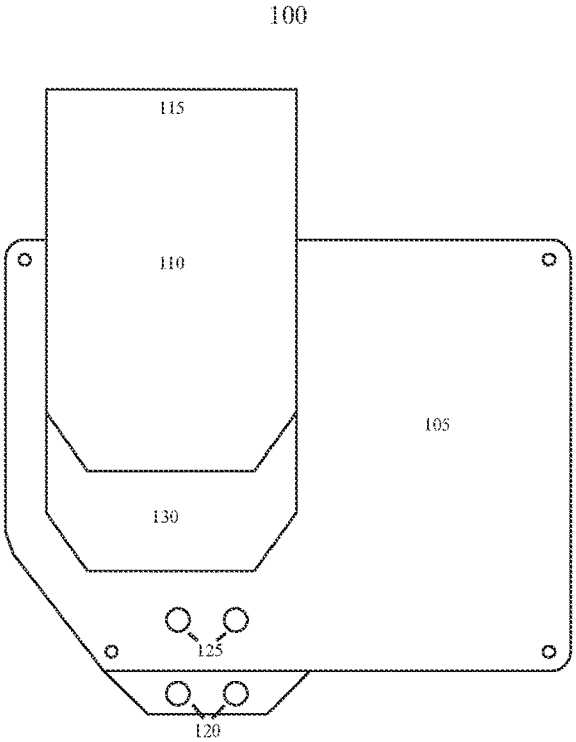
FIG. 2 is a front view 100 of a lash plate and partially inserted lash tile.

As illustrated in FIG. 2, a front view of a lash plate and lash tile being inserted is provided. Once prepared with eyelashes, the lash tile 110 can be temporarily inserted into the lash plate 105. As depicted, the partially inserted lash tile 110 slides and fits securely in the lash plate cavity 130. In other embodiments, the lash tile is attached or secured to the lash plate through various means including, but not limited to, magnets, hooks, clasps, and fasteners. Upon completion of the eyelash application, the lash tile 110 can be removed or detached from the lash plate 105 to be prepared for another customer.

Figure 3:
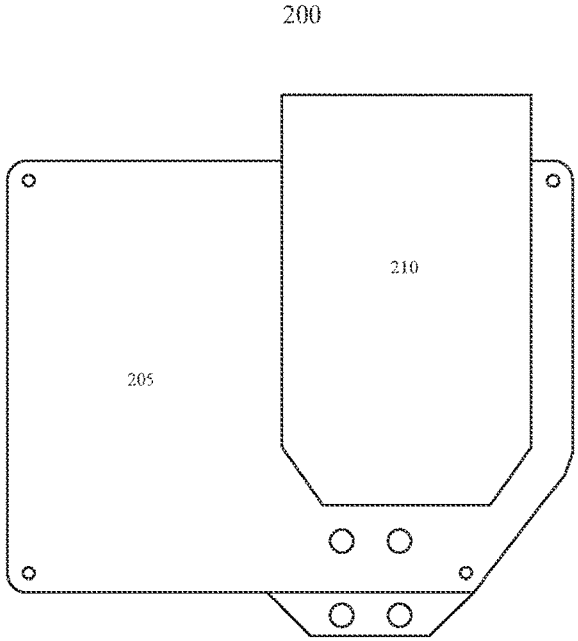
FIG. 3 is a front view 200 of an alternative lash plate and lash tile.

As illustrated in FIG. 3, a front view of an alternative lash plate and lash tile embodiment 200 is provided. As depicted, a lash plate 205 is a plate or container capable of receiving a lash tile. The lash tile 210 is temporarily inserted into or secured to the lash plate. As depicted, the lash plate 205 has a cavity where the lash tile 210 is temporarily inserted into. In the depicted alternative embodiment, the cavity and lash tile are located on the right half of the lash plate 205. Thus, the left half of the lash plate allows for the resting of a hand or arm on the surface. Additionally, it can allow for the placement of utensils or items including, but not limited to, glue, primer, removal solution, lashes, tape, tweezers, pads, micro brushes or. Such a lash plate could additionally have a recess or more shallow indentations for the items or utensils. The alternative embodiments 100, 200 allows for improved eyelash application by both left and right handed stylists.

Figure 4:
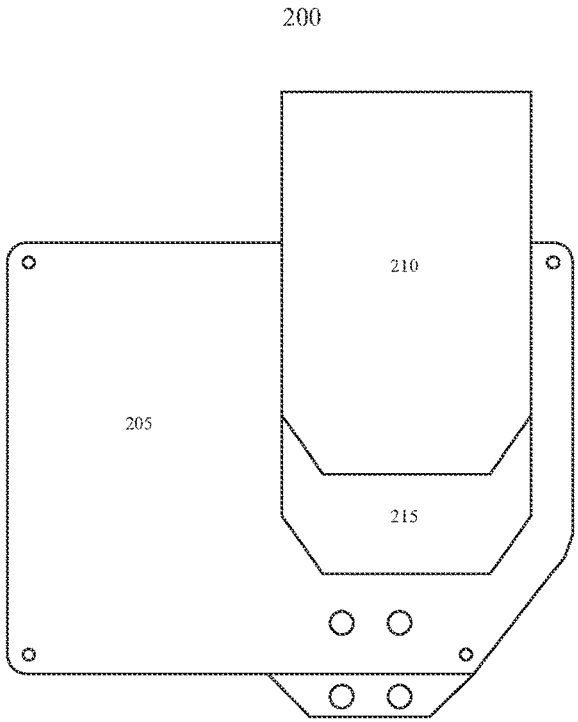
FIG. 4 is a front view 200 of an alternative lash plate and partially inserted lash tile.
Figure 5:
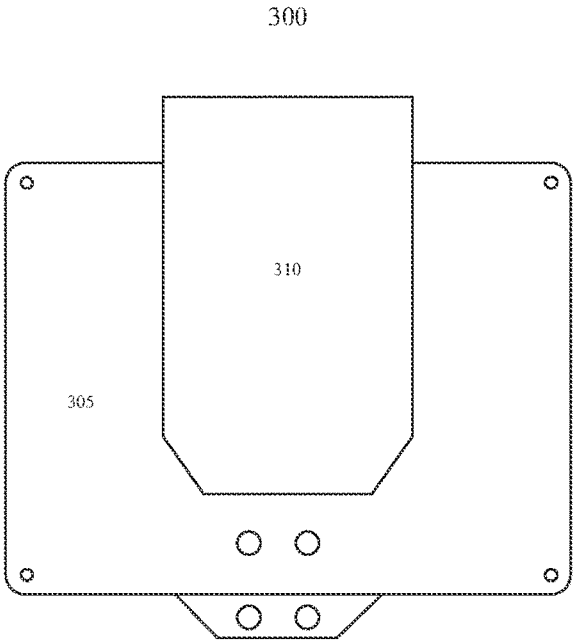
FIG. 5 is a front view 300 of an alternative lash plate and lash tile.

As illustrated in FIG. 4, a front view of an alternative lash plate and lash tile embodiment being inserted is provided. Once prepared with eyelashes, the lash tile 210 can be temporarily inserted into the lash plate 205. As depicted, the partially inserted lash tile 210 slides and fits securely in the lash plate cavity 215. In the depicted alternative embodiment, the cavity and lash tile are on the right half of the lash plate 205. Upon completion of the eyelash application, the lash tile 210 can be removed or detached from the lash plate 205 to be prepared for another customer As illustrated in FIG. 5, a front view of an alternative lash plate and lash tile embodiment 300 is provided. As depicted, a lash plate 305 is a plate or container capable of receiving a lash tile. The lash tile 310 is temporarily inserted into or secured to the lash plate. As depicted, the lash plate 305 has a cavity where the lash tile 310 is temporarily inserted into. In the depicted alternative embodiment, the cavity and lash tile are located in the center of the lash plate 305. This can allow for the resting of a hand or arm on the surface on either side of the lash tile. Additionally, it can allow for the placement of utensils or items including, but not limited to, glue, primer, removal solution, lashes, tape, tweezers, pads, micro brushes or. Such a lash plate could additionally have a recess or more shallow indentations for the items or utensils. This alternative embodiment 300 allows for improved eyelash application by both left and right handed stylists.

Figure 6:
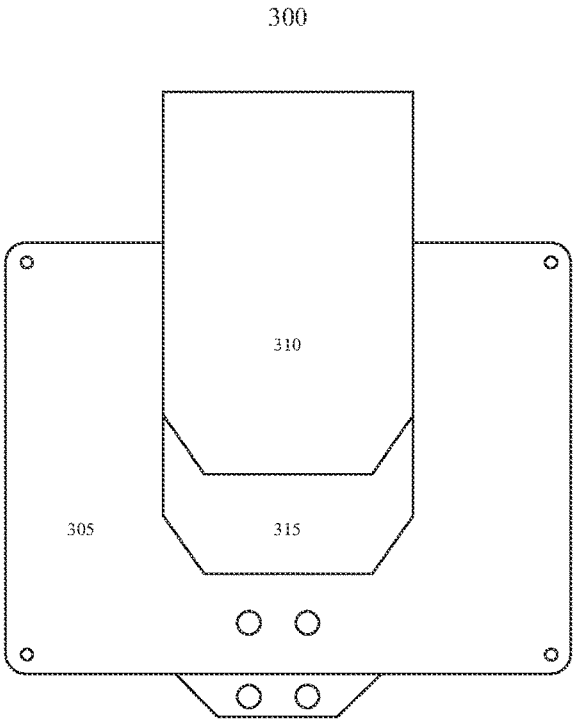
FIG. 6 is a front view 300 of an alternative lash plate and partially inserted lash tile.
Figure 7:
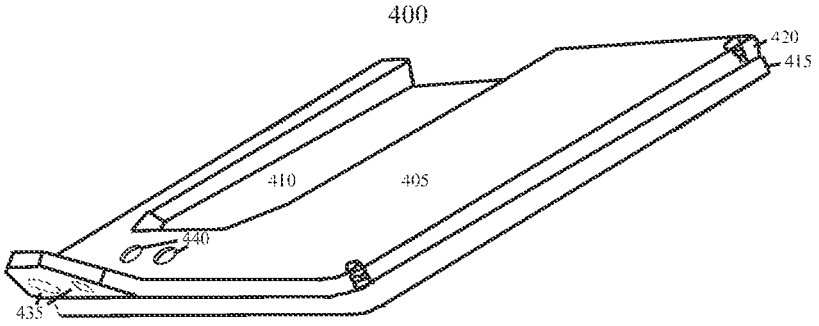
FIG. 7 is a side perspective view 400 of a lash plate.

As illustrated in FIG. 6, a front view of an alternative lash plate and lash tile embodiment being inserted is provided. Once prepared with eyelashes, the lash tile 310 can be temporarily inserted into the lash plate 305. As depicted, the partially inserted lash tile 310 slides and fits securely in the lash plate cavity 315. In the depicted alternative embodiment, the cavity and lash tile are in the center of the lash plate 305. Upon completion of the eyelash application, the lash tile 310 can be removed or detached from the lash plate 305 to be prepared for another customer As illustrated in FIG. 7, a side perspective view of a lash plate embodiment 400 is provided. In the depicted embodiment, the lash plate is created from separate components that are permanently affixed to each other. This can be done by various means including, but not limited to, screws, bolts, dowels, nails, pins, and rivets. The back component 415 is the full perimeter of the lash plate 405. The front component 420 has the cavity 410 cut out, such that when the two components are permanently affixed to each other, the cavity 410 is created. As depicted, the cavity opens at the top edge of the lash plate for insertion of the lash tile at the top edge of the lash plate. In other embodiments, the front component can also be the full perimeter of the last plate with a fully enclosed cavity cut out. Alternatively, lash plate embodiments may be a single component, where a mold is employed to create the cavity. Further embodiments may be created with no cavity.

Figure 8:
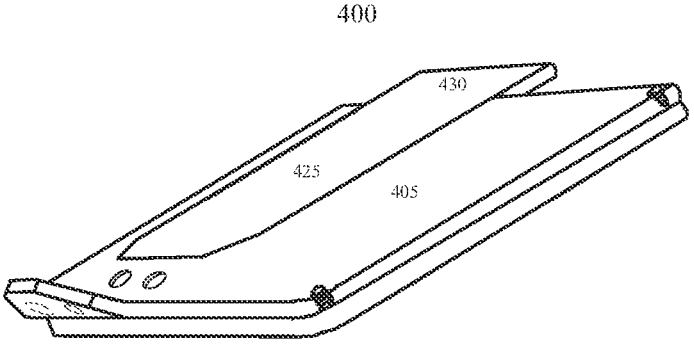
FIG. 8 is a side perspective view 400 of a lash plate and lash tile.

As illustrated in FIG. 8, a side perspective view of a lash plate and lash tile embodiment 400 is provided. In the depicted embodiment, the lash plate 405 is created from separate components that are permanently affixed to each other. The lash tile 425 is shown temporarily inserted into the lash plate cavity. In other embodiments, magnets, fasteners or other means may be used to attach, or secure the lash tile to the lash plate. In the depicted embodiment, a portion 430 of the lash tile extends outside the perimeter of the lash plate 405 so that it can be easily gripped for easy insertion and removal. In other embodiments, a lash tile can include more defined handle or grip.

As illustrated in FIGS. 7 and 8, a holder 435 for the adhesive used in eyelash application extends from the bottom of the lash plate. In other embodiments, the holder for the adhesive can be extend from one of the sides or top of the lash plate. Additionally, the adhesive holder 440 can exist on the front of the lash plate, similar to the lash plate cavity.

Figure 9:
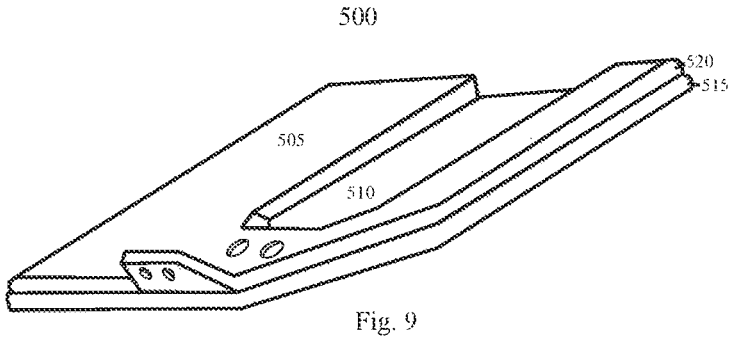
FIG. 9 is a side perspective view 500 of an alternative lash plate.

As illustrated in FIG. 9, a side perspective view of a lash plate embodiment 500 is provided. In the depicted embodiment, the lash plate is created from separate components that are permanently affixed to each other. This can be done by various means including, but not limited to, screws, bolts, dowels, nails, pins, and rivets. The back component 515 is the full perimeter of the lash plate 505. The front component 520 has the cavity 510 cut out, such that when the two components are permanently affixed to each other, the cavity 510 is created. As depicted, the cavity opens at the top edge of the lash plate for insertion of the lash tile at the top edge of the lash plate. In other embodiments, the front component can also be the full perimeter of the last plate with a hilly enclosed cavity cut out. Alternatively, lash plate embodiments may be a single component, where a mold is employed to create the cavity. Further embodiments may be created with no cavity.

In the depicted alternative embodiment, the cavity and lash tile are located on the right half of the lash plate 505. Thus, the left half of the lash plate allows for the resting of a hand or arm on the surface. Additionally, it can allow for the placement of utensils or items including, but not limited to, glue, primer, removal solution, lashes, tape, tweezers, pads, micro brushes or. Such a lash plate could additionally have a recess or more shallow indentations for the items or utensils. The alternative embodiments 400, 500 allows for improved eyelash application by both left and right handed stylists.

Figure 10:
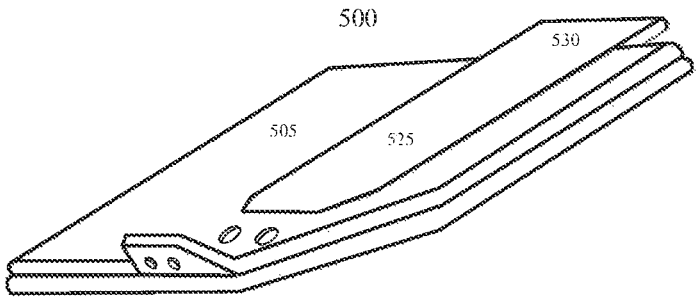
FIG. 10 is a side perspective view 500 of an alternative lash plate and lash tile.

As illustrated in FIG. 10, a side perspective view of a lash plate and lash tile embodiment 500 is provided. In the depicted embodiment, the lash plate 505 is created from separate components that are permanently affixed to each other. The lash tile 525 is shown temporarily inserted into the lash plate cavity. In other embodiments, magnets, fasteners or other means may be used to attach, or secure the lash tile to the lash plate. In the depicted embodiment, a portion 530 of the lash tile extends outside the perimeter of the lash plate 505 so that it can be easily gripped for easy insertion and removal. In other embodiments, a lash tile can include more defined handle or grip.

Figure 11:
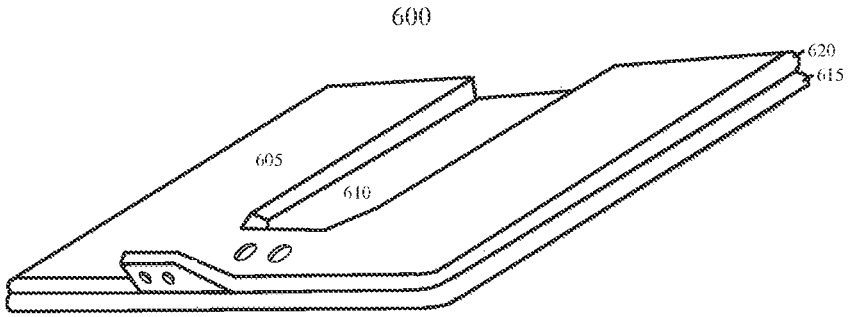
FIG. 11 is a side perspective view 600 of an alternative lash plate.

As illustrated in FIG. 11, a side perspective view of a lash plate embodiment 600 is provided. In the depicted embodiment, the lash plate is created from separate components that are permanently affixed to each other. This can be done by various means including, but not limited to, screws, bolts, dowels, nails, pins, and rivets. The back component 615 is the full perimeter of the lash plate 605. The front component 620 has the cavity 610 cut out, such that when the two components are permanently affixed to each other, the cavity 610 is created. As depicted, the cavity opens at the top edge of the lash plate for insertion of the lash tile at the top edge of the lash plate. In other embodiments, the front component can also be the full perimeter of the last plate with a fully enclosed cavity cut out. Alternatively, lash plate embodiments may be a single component, where a mold is employed to create the cavity. Further embodiments may be created with no cavity.

In the depicted alternative embodiment, the cavity and lash tile are located in the center of the lash plate 605. This can allow for the resting of a hand or arm on the surface on either side of the lash tile. Additionally, it can allow for the placement of utensils or items including, but not limited to, glue, primer, removal solution, lashes, tape, tweezers, pads, micro brushes or. Such a lash plate could additionally have a recess or more shallow indentations for the items or utensils. This alternative embodiment 600 allows for improved eyelash application by both left and right handed stylists.

Figure 12:
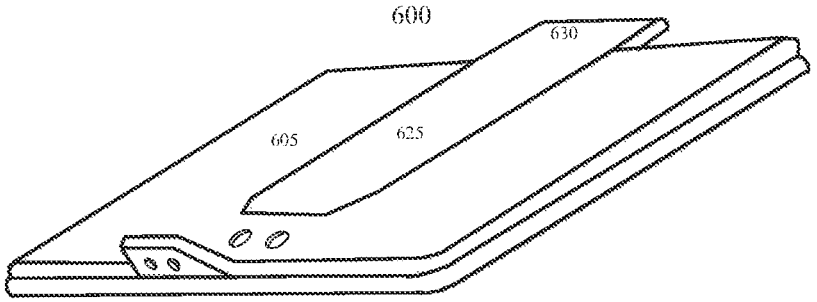
FIG. 12 is a side perspective view 600 of an alternative lash plate and lash tile.

As illustrated in FIG. 12, a side perspective view of a lash plate and lash tile embodiment 600 is provided. In the depicted embodiment, the lash plate 605 is created from separate components that are permanently affixed to each other. The lash tile 625 is shown temporarily inserted into the lash plate cavity. In other embodiments, magnets, fasteners or other means may be used to attach, or secure the lash tile to the lash plate. In the depicted embodiment, a portion 630 of the lash tile extends outside the perimeter of the lash plate 605 so that it can be easily gripped for easy insertion and removal. In other embodiments, a lash tile can include more defined handle or grip.

Figure 13:
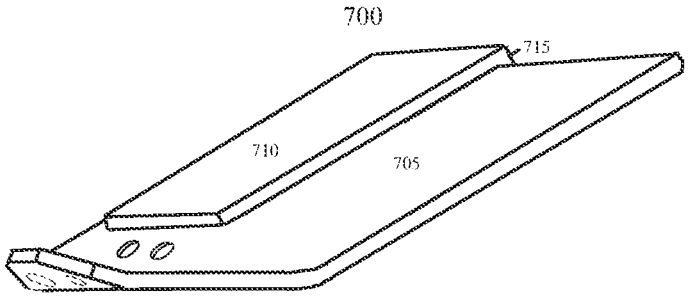
FIG. 13 is an alternative side perspective view 700 of a lash plate and lash tile.

As illustrated in FIG. 13, a side perspective view of an alternative embodiment of a lash plate and lash tile 700 is provided. In the depicted embodiment, the lash plate 705 does not have a cavity and is made of a single plate component. The lash tile 710 is supported by a small protrusion 715 of the top back edge that extends back over the top edge of the lash plate 705. In other embodiments, magnets, fasteners or other means may be used to temporarily attach, or secure the lash tile to the lash plate when there is no cavity.

Figure 14:
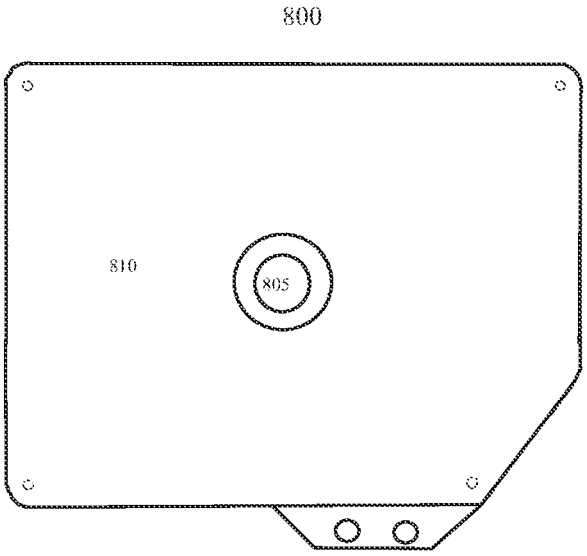
FIG. 14 is a rear view 800 of a lash plate.

As illustrated in FIG. 14, a rear view of a lash plate embodiment 800 is provided. As depicted, a circular coupling allows 805 for connecting, to the eyelash tray assembly, a means for supporting the eyelash plate assembly. Located on the back of the lash plate 810, this coupling 805 acts as a socket for the insertion of a ball joint bearing. A ball joint is preferred for allowing a large range of motion and rotation, but the disclosed invention contemplates other couplings or clasps for attaching a means for supporting the eyelash plate assembly. Further, the coupling or clasp can be located on the front of the lash plate or one of the sides.

Figure 15:
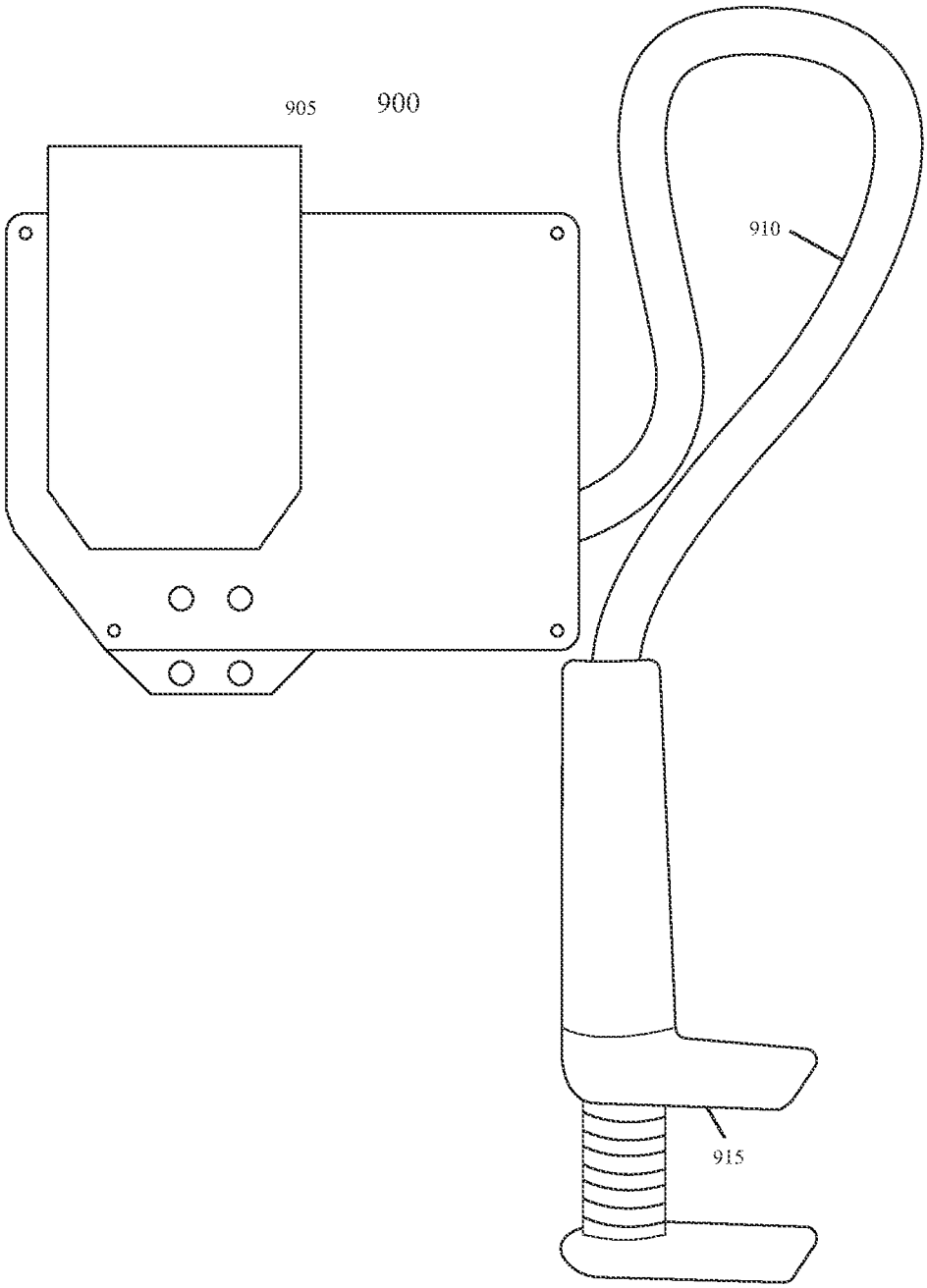
FIG. 15 is a front view 900 of an eyelash plate assembly and means of supporting such lash assembly.

As illustrated in FIG. 15, a front view of an eyelash plate assembly and means of supporting such lash assembly 900 is provided. As depicted, a flexible arm 910 is used to support and position the eyelash plate assembly 905 near the customer during eyelash application. The arm 910 is connected to the eyelash plate assembly 905 with a ball and socket joint on the back of the lash plate. Other embodiments may employ other connectors including, but not limited to, a clasp on the arm that grips and holds in place the eyelash plate assembly. At the opposite end of the arm, a clasp or clamp 915 secures the arm to the chair of the stylist or client. Such a clasp can be used to secure the arm to other stationary objects, such as a bed or table, or other movable object such as a rolling cart, or to a wall or ceiling.

Figure 16:
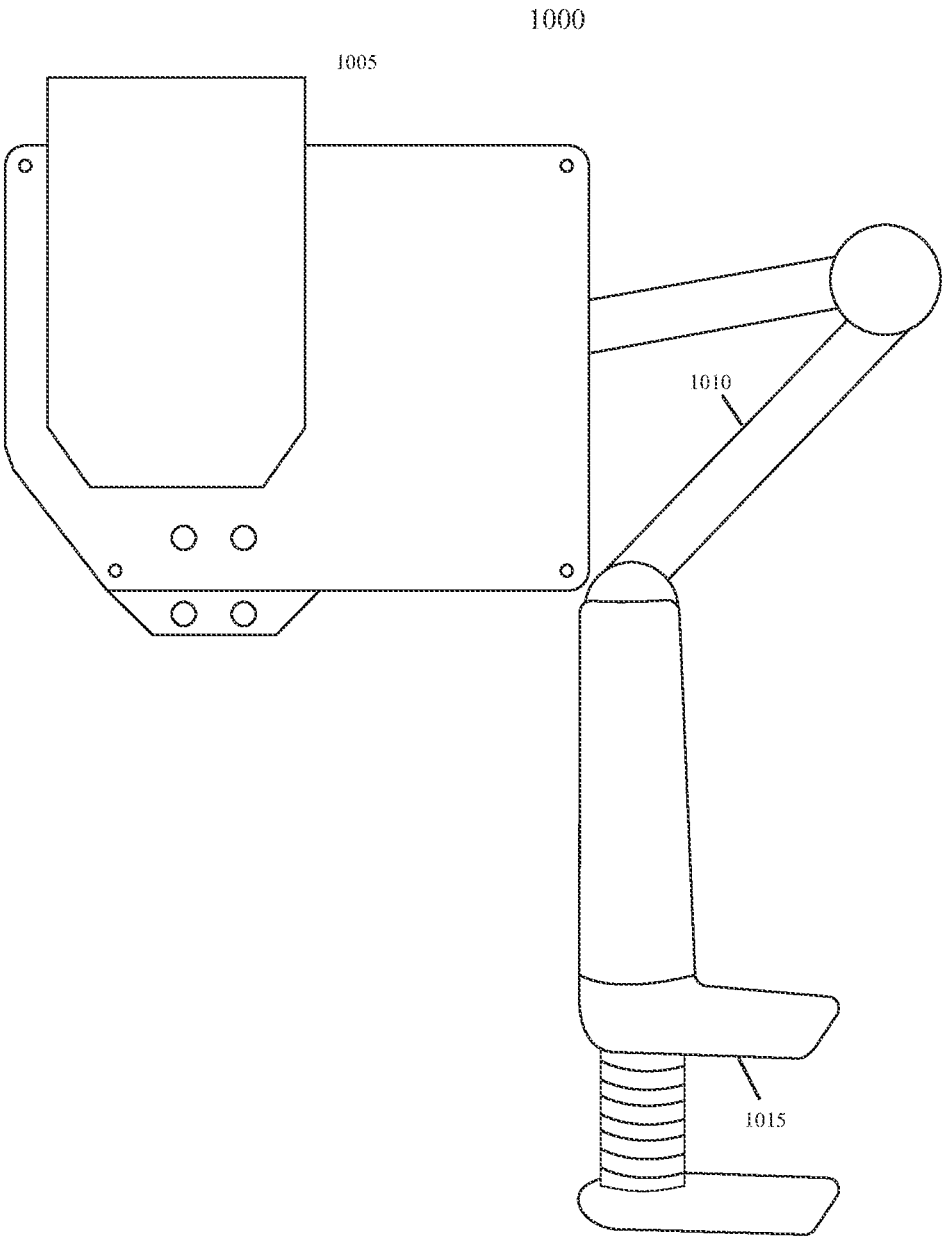
FIG. 16 is a front view 1000 of an eyelash plate assembly and alternative means of supporting such lash assembly.

As illustrated in FIG. 16, a front view of an eyelash plate assembly and alternative means of supporting such lash assembly 1000 is provided. As depicted, a jointed arm 1010 is used to support and position the eyelash plate assembly 1005 near the customer during eyelash application. The arm 805 is comprised of rods of varying lengths connected by varying joints, such as hinges, swivels and ball and socket. The arm 1010 is connected to the eyelash plate assembly 1005 with a ball and socket joint on the back of the lash plate. Other embodiments may employ other connectors, including but not limited to a clasp on the arm that grips and holds in place the eyelash plate assembly. At the opposite end of the arm, a clasp or clamp 1015 secures the arm to the chair of the stylist or client. Such a clasp 1015 can be used to secure the arm to other stationary objects, such as a bed or table, or other movable object such as a rolling cart, or to a wall or ceiling.

Figure 17:
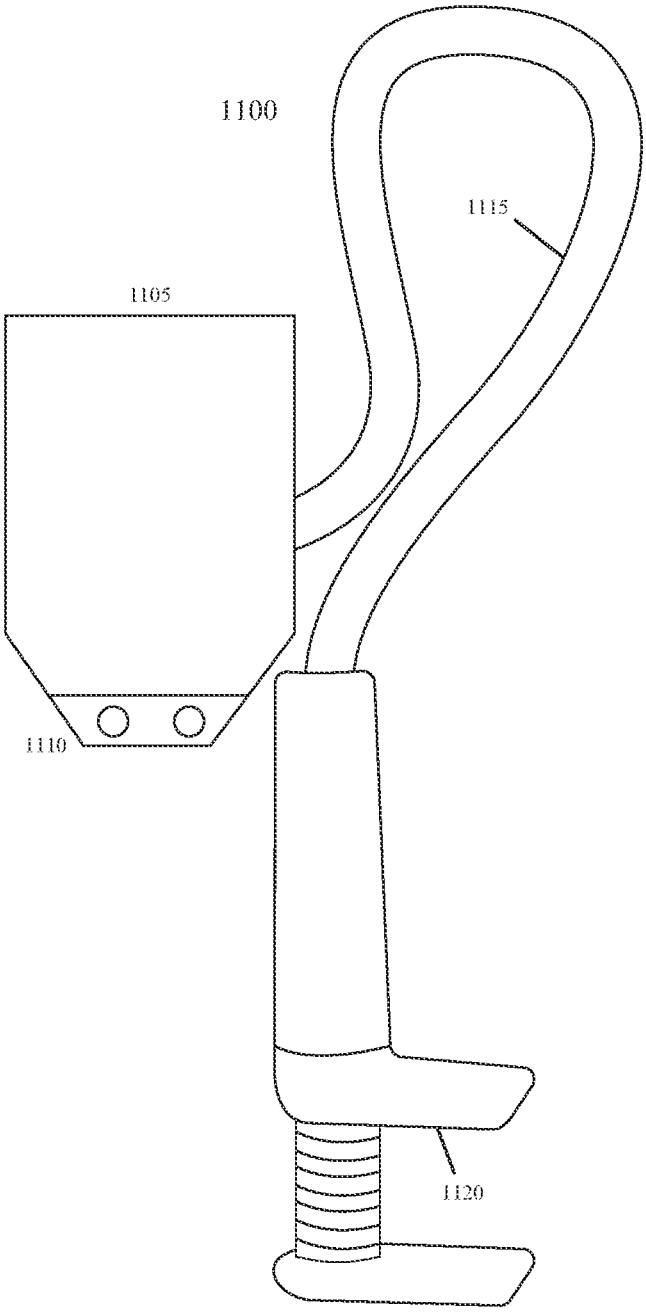
FIG. 17 is a front view 1100 of an alternative eyelash plate assembly and means of supporting such lash assembly.

As illustrated in FIG. 17, a front view of an alternative eyelash plate assembly and means of supporting such lash assembly 1100 is provided. In such an embodiment, a lash tile 1105 acts as both the plate and tile. The lash tile 1105 is similarly prepared with the eyelashes to be applied. The lash tile 1105 can additionally has the one of more holders 1110 capable of holding the adhesive used to apply the eyelashes. In the depicted embodiments, the lash tile 1105 has a circular coupling allowing for connecting, to the eyelash plate assembly, a means for supporting the lash tile 1105. A flexible arm 1115 is used to support and position the lash tile 1105 near the customer during eyelash application. Other embodiments may use a jointed arm is comprised of rods of varying lengths connected by varying joints, such as hinges, swivels and ball and socket. The arm 1115 is connected to the lash tile with a ball and socket joint on the back of the lash plate. Other embodiments may employ other connectors including, but not limited to, a clasp on the arm that grips and holds in place the eyelash plate assembly. At the opposite end of the arm, a clasp or clamp 1120 secures the arm to the chair of the stylist or client. Such a clasp 1120 can be used to secure the arm to other stationary objects, such as a bed or table, or other movable object such as a rolling cart, or to a wall or ceiling.

Figure 18:
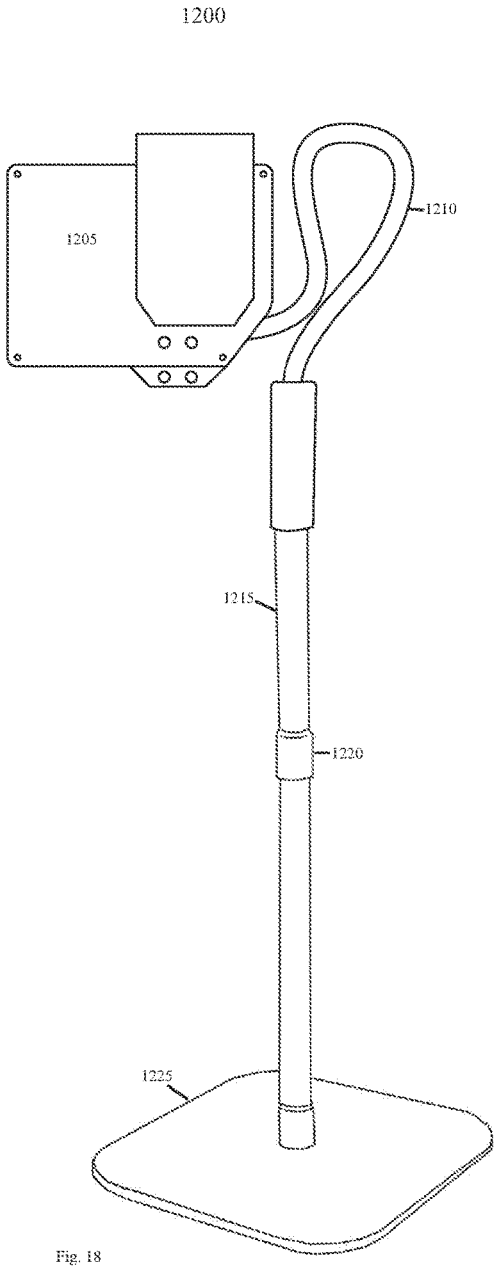
FIG. 18 is a front view 1200 of an eyelash plate assembly and alternative means of supporting such lash assembly.

As illustrated in FIG. 18, a front view of an eyelash plate assembly and means of supporting such lash assembly 1200 is provided. As depicted, a flexible arm 1210 is attached the eyelash plate assembly 1205. At the opposite end of the arm is a stand comprising a pole 1215 and having a base 1225 that is stationary. The stand can also have a means 1220 for changing the length of the pole, raising and lowering the eyelash plate assembly as the stylist prefers.

Figure 19:
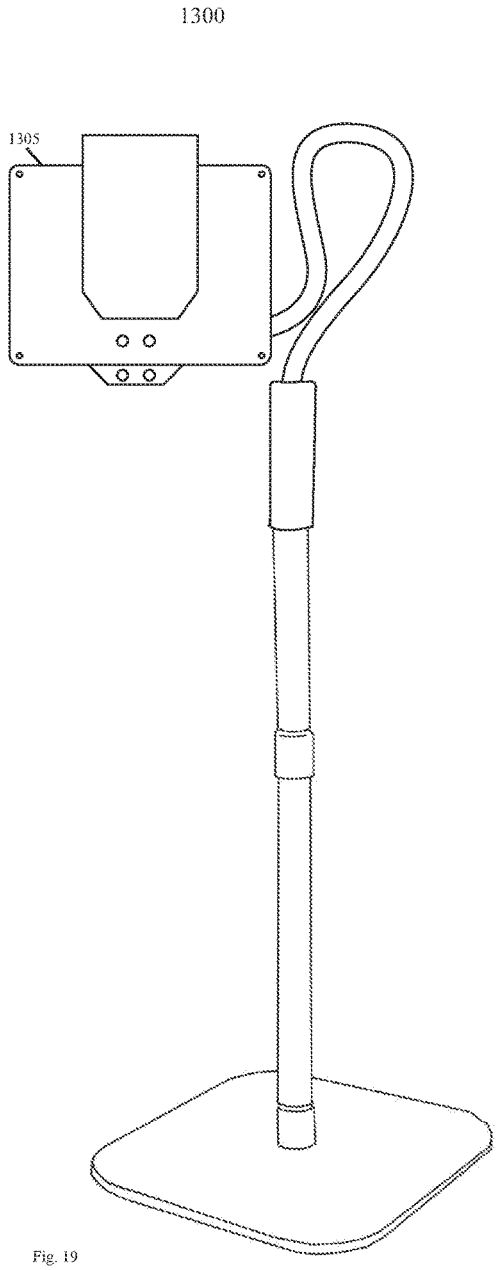
FIG. 19 is a front view 1300 of an eyelash plate assembly and alternative means of supporting such lash assembly.
Figure 20:
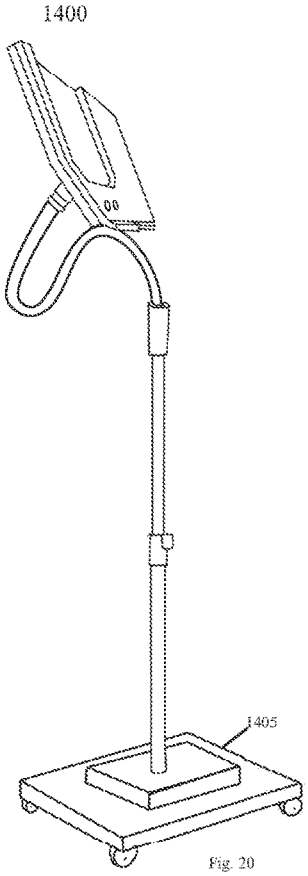
FIG. 20 is a front view 1400 of an eyelash plate assembly and alternative means of supporting such lash assembly.
Figure 21:
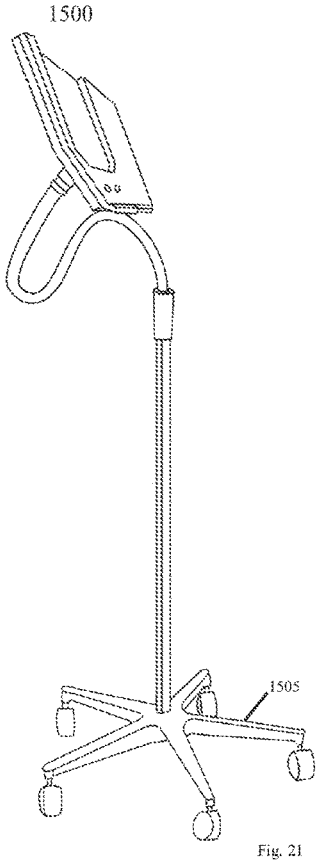
FIG. 21 is a front view 1500 of an eyelash plate assembly and alternative means of supporting such lash assembly.
Figure 22:
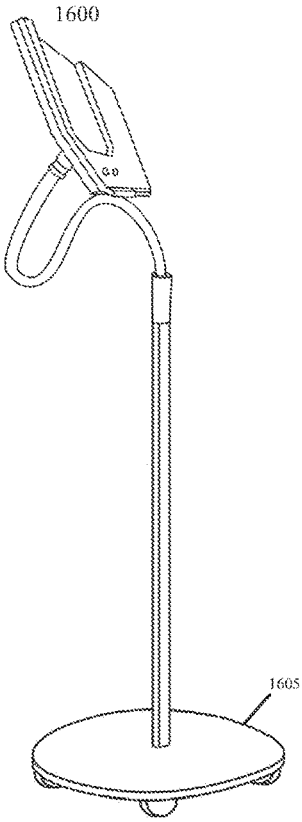
FIG. 22 is a front view 1600 of an eyelash plate assembly and alternative of supporting such lash assembly.
Figure 23:
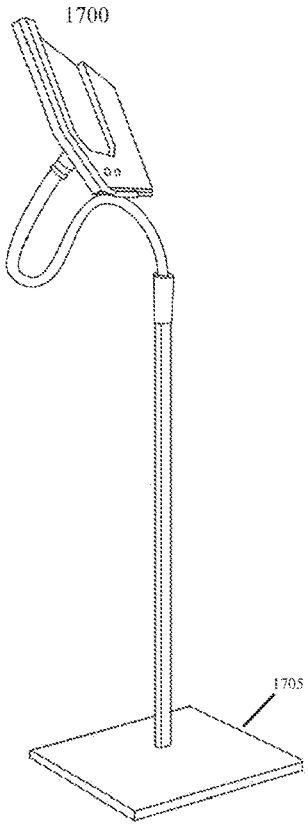
FIG. 23 is a front view 1700 of an eyelash plate assembly and alternative means of supporting such lash assembly.

As illustrated in FIG. 19, a front view of an eyelash plate assembly and means of supporting such lash assembly 1300 is provided. In the depicted alternative embodiment, the cavity and lash tile are located in the center of the lash plate 1305.

As illustrated in FIGS. 20, 21, 22, and 23, other eyelash plate assembly and means of supporting such lash assembly embodiments 1400, 1500, 1600, and 1700 are provided. As depicted, a flexible arm is attached the eyelash plate assembly. At the opposite end of the arm in depicted embodiments is a stand having a base that can be stationary or movable. The depicted embodiments include a podium or stand having a base that is stationary 1705 or movable 1405, 1505, 1605 having wheels or other means for rolling. Such podiums or stands can include adjustable height and swivel features. The eyelash plate assembly can also be supported directly by a stand without a flexible or jointed arm. This disclosure contemplates multiple and varying means for supporting and positioning the eyelash plate assembly near the customer during eyelash application.

The eyelash plate assembly could additionally include other features. Such as a mirror or a light source, either built into or extending from the lash plate.

The preceding description contains embodiments of the invention and no limitation of the scope is thereby intended.

That which is claimed is:

1. An eyelash plate assembly comprising:
a flat lash plate and a removable lash tile;
the flat lash plate defined by an opposed flat top surface and bottom surface; a top edge, bottom edge, and opposing side edges; and the flat last plate further comprising a cavity recessed into the top surface; and
the lash tile comprising a flat tile with an opposing top surface and bottom surface, the top surface configured to removably receive eyelashes to be applied to a client;
wherein the lash tile is configured to be slid into the cavity and secured within the cavity and is removable via a portion of the lash tile that extends beyond the top edge of the lash plate when the lash tile is removably secured within the cavity.

2. The eyelash plate assembly of claim 1, wherein the cavity is fully enclosed within the perimeter of the lash plate.

3. The eyelash plate assembly of claim 1, wherein the cavity opens at the top edge of the lash plate for insertion of the lash tile at the top edge of the lash plate.

4. The eyelash plate assembly of claim 1 further comprising:
an arm attached to the lash plate at one end and having a means for securing to objects at the opposite end.

5. The eyelash plate assembly of claim 4, wherein the arm is flexible.

6. The eyelash plate assembly of claim 4, wherein the arm is jointed.

7. The eyelash plate assembly of claim 4, wherein arm is attached to the lash plate via a ball and socket joint.

8. The eyelash plate assembly of claim 1 further comprising:
a stand attached to the lash plate and having a base that rests on a surface.

9. The eyelash plate assembly of claim 8, wherein stand is stationary.

10. The eyelash plan: assembly of claim 8, wherein the stand is movable.

11. The eyelash plate assembly of claim 1 further comprising:
an arm attached to the lash plate at one end and attached to a stand at the opposite end;
a stand attached to the arm having a base that rests on a surface.

12. The eyelash plate assembly of claim 1, wherein the lash tile is located on a left half of the lash plate top surface such that a right half of the lash plate top surface is configured for resting of a hand or arm of a user.

13. The eyelash plate assembly of claim 1, wherein the lash tile is located on a right half of the lash plate top surface such that a left half of the lash plate top surface is configured for resting of a hand or arm of a user.

14. The eyelash plate assembly of claim 1 further comprising:
holders for holding a cup containing adhesive.

15. The eyelash plate assembly of claim 14, wherein the holders are ho from an edge of the lash plate.

16. The eyelash plate assembly of claim 14, wherein the holders are concavities on the surface of the lash plate.

17. An eyelash plate assembly comprising:
a flat lash plate and a removable lash tile;
the lash plate comprising an opposing top surface and bottom surface defined by a top edge, bottom edge, and opposing side edge; and a cavity recessed into the top surface of the plate;

the lash tile comprising an opposing top surface and bottom surface defined by a top edge, bottom edge, and opposing side edges, the top surface receiving eyelashes to be applied to a client;

wherein the lash tile is configured to be slid into the cavity and removably secured within the cavity of the lash plate such that the bottom edge of the lash tile contacts one or more walls of the cavity of the lash plate when the lash tile is removably secured within the cavity.

18. The eyelash plate assembly of claim 17, wherein the cavity opens at the top edge of the lash plate for insertion of the lash tile at the top edge of the lash plate.

19. The eyelash plate assembly of claim 17 further comprising:

an arm attached to the lash plate at one end and having a means for securing to objects at the opposite end.

* * * * *